United States Patent [19]

Jullien

[11] Patent Number: 4,492,896

[45] Date of Patent: Jan. 8, 1985

[54] ELECTRONIC CANDLE SYSTEM

[75] Inventor: Graham A. Jullien, Windsor, Canada

[73] Assignee: James J. Ogilvy, Windsor, Canada

[21] Appl. No.: 491,447

[22] Filed: May 4, 1983

[30] Foreign Application Priority Data

Nov. 18, 1982 [CA] Canada ..... 415826

[51] Int. Cl.[3] ..... H05B 37/02

[52] U.S. Cl. ..... 315/153; 315/195; 315/317; 362/810

[58] Field of Search ..... 315/151, 153, 184, 195, 315/211, 217, 250, 317; 362/810

[56] References Cited

U.S. PATENT DOCUMENTS 3,435,286 3/1969 Kayatt ..... 362/810
3,500,126 3/1970 Ford ..... 362/810
3,789,211 1/1974 Kramer ..... 315/195
4,417,182 11/1983 Weber ..... 315/317

*Primary Examiner*—Harold Dixon
*Attorney, Agent, or Firm*—Leonard Bloom

[57] ABSTRACT

The present invention relates to an array of simulated candles, utilizing light bulbs, which allows the user to turn on any selected light bulb merely by pointing a wand close to the light bulb to be turned on. Once turned on the light bulbs are caused to flicker in a manner which simulates very realistically the flickering of candle flames, including the increase and decrease of the illumination of all of the light bulbs (or selected groups of light bulbs if desired) which are observable in an array of candles during random breezes encountered by the candles in a room.

20 Claims, 11 Drawing Figures

MEMORY MAP

ELECTRONIC CANDLE SYSTEM

Figure 1:
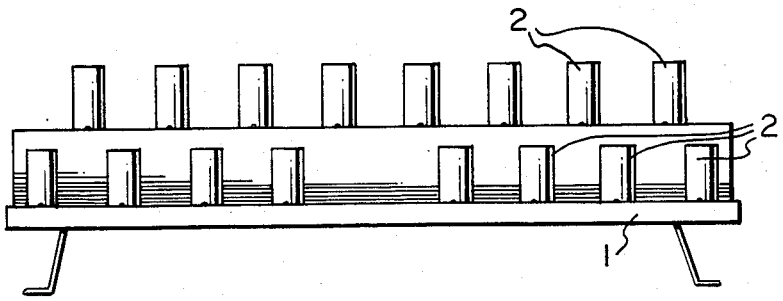

This invention relates to an electric simulated candle array and particularly to one in which each simulated candle can be lit without touching it or a switch associated with it. In addition all of the simulated candles which have been lit are able to flicker in a very realistic manner which simulates very closely the flickering of an actual candle.

Candle arrays are used in some churches, in association with memorials, etc. and are sometimes lit in association with the donation of money. For example, participants in a service who make a donation are allowed to light one of the candles of the array. It has been found, however, that the cost of candles has been increasing and often exceeds the value of the donation.

Further, arrays of candles which have been lit are usually allowed to burn completely, often overnight when the building has been deserted. Obviously this forms a fire hazard which raises the cost of fire insurance or renders a building uninsurable.

For the above reasons an array of light bulbs have been used in a simulated candle array, with a switch associated with each light bulb. Upon payment of a donation, the donator turns on a switch, illuminating the light bulb.

The procedure of operating a switch to turn on a light bulb instead of lighting a candle has been found to be unsatisfactory, since it detracts from the "mystic" of lighting and watching a candle. Consequently the use of light bulbs to replace candles has only been implemented where absolutely necessary.

The present invention provides an array of simulated candles, utilizing light bulbs, which allows the user to turn on any selected light bulb merely by pointing a wand close to the light bulb to be turned on, rather than turning on a switch. This has been found to be a significant advance over the manually switched apparatus described above. Further, the light bulbs are caused to flicker in a manner which simulates very realistically the flickering of candle flames, including the increase and decrease of the illumination of all of the light bulbs (or selected groups of light bulbs if desired) which are observable in an array of candles during random breezes encountered by the candles in a room.

The resulting simulating candle array has been found to be highly acceptable by users, and indeed, comments have been heard by users concerning a prototype model that the array is difficult to distinguish from a real candle array from any reasonable distance.

It will be clear that while the description of the invention below is directed to a simulated candle array, the principles can of course be directed to any decorative light array, e.g. as might be found on a memorial plaque, decorations in a theatre, etc.

The invention in general is a decorative light array comprising a plurality of light bulbs, a wand for manually pointing to a light bulb, apparatus for sensing which light bulb has been pointed to by the wand, and apparatus for lighting the light bulb upon the sensing having been completed.

More particularly, the invention is a simulated candle array comprising a plurality of light bulbs, mounted so as to look like an array of candles, apparatus for applying short bursts of current to the light bulbs so as to repetitively illuminate the light bulbs for short intervals in a predetermined sequence during a candle selection process, a sensor to be manually brought into adjacency to one of the light bulbs, apparatus connected to the sensor for detecting at least one of the short intervals of illumination of one of the light bulbs caused by the short bursts of current, and apparatus for applying operating current to the one light bulb so as to light it visibly to the unaided eye upon the sensing having been completed.

According to one embodiment, apparatus is provided for applying operating current to the one and other light bulbs which may be visibly lit to the unaided eye during varying and random time intervals so as to give the one and other light bulbs the appearance of random flickering.

According to a further embodiment, apparatus is provided for further modulating the time intervals in unison so as to give the one and other light bulbs the appearance of a unified and varying intensity of flickering modulated with the random flickering, thus simulating the brightening and darkening effect of a breeze operating on an array of lit and flickering candles.

Figure 2:
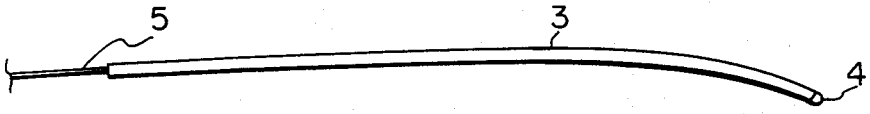
Figure 8:
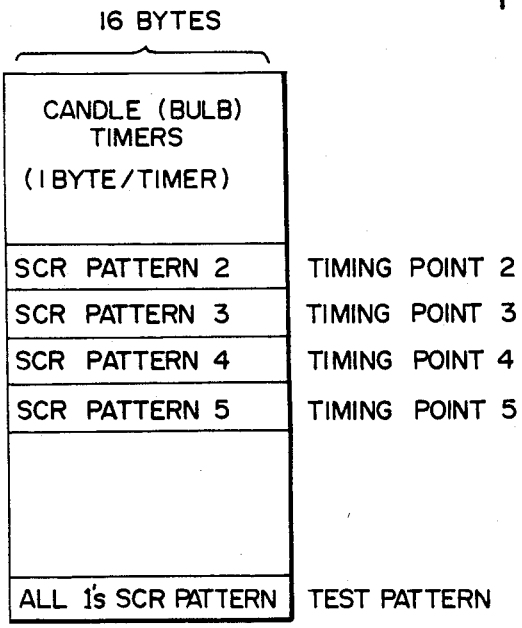
Figure 3:
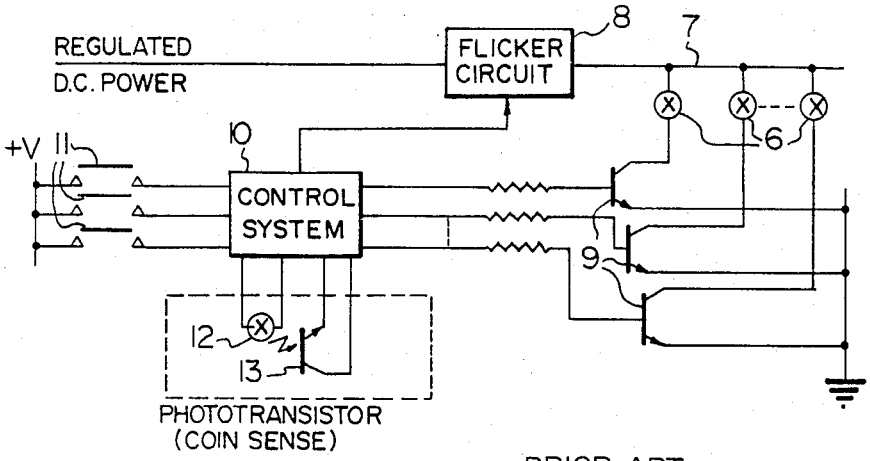
PRIOR ART FIG. 3
Figure 4:
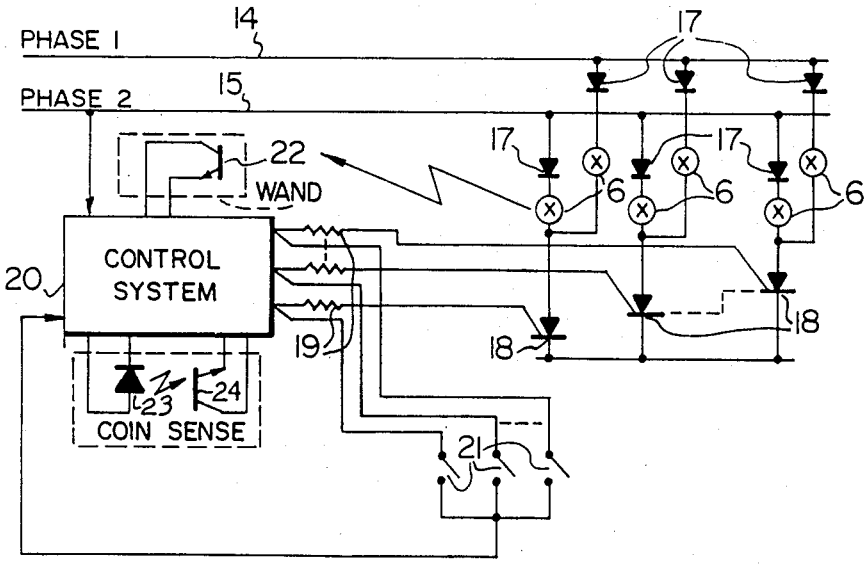
Figure 5:
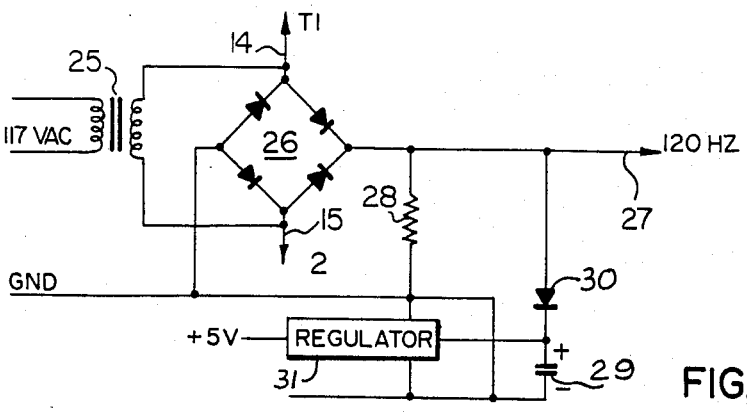
Figure 5A:
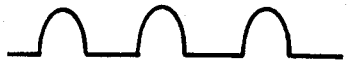
Figure 5B:
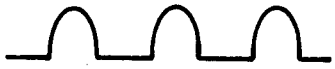
Figure 6A:
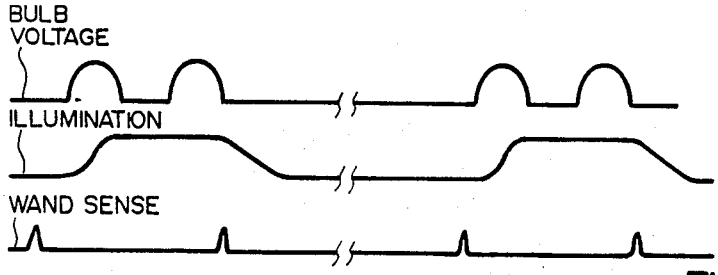
Figure 7:
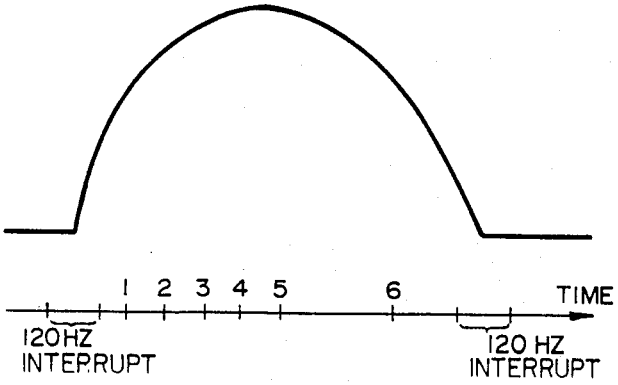
Figure 6:
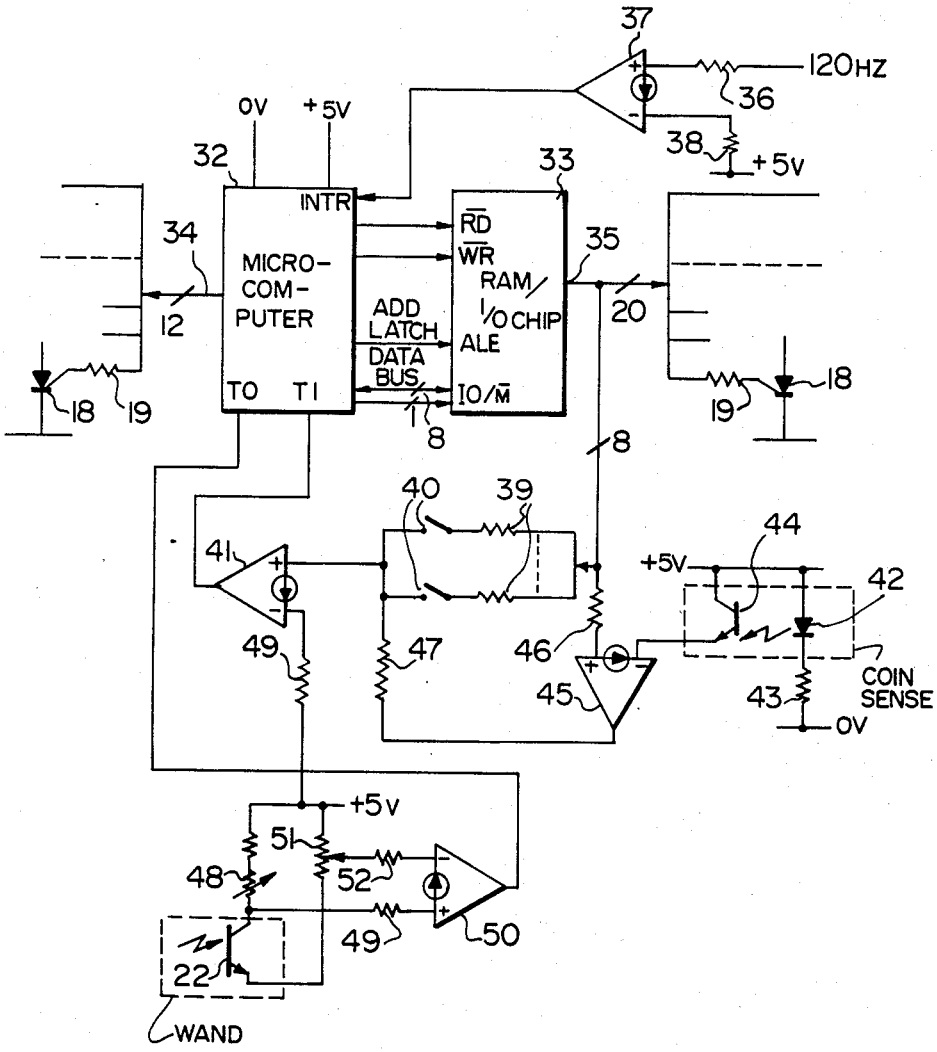

A better understanding of the invention will be obtained by reference of the detailed description below, with reference to the following drawings, in which:

FIG. 1 is a representative front view of an array of electric simulated candles, FIG. 2 shows a wand used for illuminating the light bulbs, FIG. 3 is a part schematic and part block diagram of an embodiment according to the prior art, FIG. 4 is a part schematic and part block diagram of the preferred form of the invention, FIG. 5 is a schematic diagram of a power supply used in the preferred form of the invention, FIGS. 5A and 5B show wave forms of operating power at two points in FIG. 5, FIG. 6 is a schematic diagram showing the content of one of the blocks of FIG. 4, FIG. 6A is a waveform and timing diagram used to illustrate how a light bulb is sensed, FIG. 7 is a timing diagram of a current cycle applied to a light bulb of the array, and FIG. 8 depicts the memory content plan in one embodiment of the invention.

Turning first to FIG. 1, a stand 1 is shown on which an array of simulated candles 2 is fixed. Previously, the array would have been of actual candles, but in relatively recent times, simulated candles were substituted for actual candles. Each of the simulated candles was comprised of a cylindrical housing, often colored, within which a light bulb was located. Switches, one connected in series with a power lead to each light bulb were fixed to the stand, one switch being associated with each simulated candle. The user would manually turn on the switch, which illuminated the simulated candle. Sometimes a neon bulb was used which randomly changed position with time in an attempt to simulate a real candle flame.

A more sophisticated prior art embodiment, prior to this invention, used a simple electronic system to sense a switch closure and turn on an electronic switch (transistor) to the appropriate candle bulb. The electronic system incorporated a timer for each candle and a simple, but unrealistic, candle flickering effect. The system required the use of an expensive, high current, regulated supply to the candle bulbs.

In that system, shown in FIG. 3, a plurality of simulated candle bulbs 6 (i.e. 12 volt incandescent light bulbs) are connected each with a common terminal to a line 7 carrying operating current. A source of DC power is supplied through a flicker circuit 8 to the line carrying operating current. Each of the candle bulbs is connected through the collector-emitter circuit of a transistor 9 to ground. The base (acting as a switch gate) of each of the transistors is connected to the ports of a control system 10, thus enabling conduction through the collector-emitter circuit of a transistor to light the bulb at the required time.

Further, the control system is connected to the flicker circuit 8 which causes it to modulate the regulated current to the candle bulbs in order to simulate flickering. The amplitude of the current flow is controlled by the control system 10.

Closure of one of the switches 11 enables the electronic system 10 to apply current to the base of a transistor associated with a light bulb which is itself associated with the switch which is turned on, thus passing current and allowing the candle bulb to turn on.

The above procedure operates after the electronic system 10 has detected that a coin has been inserted in a coin slot. This is simply done by a lamp 12 illuminating a photo-transistor 13 across a coin chute. Interruption of the light detected by the photo-transistor causes a pulse to be presented to the control system 10 via the photo-transistor, enabling it to detect subsequent closure of one of the switches 11.

It is clear that in the system just described a switch must be turned on for each light bulb which is operated. Further, the flicker circuit causes all of the candle bulbs to flicker in unison, which has been found to be not as realistic as my invention to be described below. Also the flicker circuit requires a heavy duty regulated supply for the candle bulbs which increases the expense, weight and heat generation of the electronic system.

According to the present invention, the simulated candle is used as before, but there is no manually operated switch associated with each candle. Instead, a wand as shown (enlarged) in FIG. 2 is used. The tip of the wand is brought into close adjacency to the candle, and as a result that candle visibly lights. All lit candles are caused to flicker, simulating an actual candle, as will be described later.

The wand is comprised of a plastic tube 3, with a photosensor 4, such as a photo-transistor glued to one end of the tube. Two wire conductors 5 pass through tube 3 and is connected to the two terminals of photoresistor 4. Conductor 5 leads to a control apparatus as will be described later.

FIG. 4 shows the preferred embodiment of the present invention. A pair of lines 14 and 15 carries opposite phases of half wave rectified power which is derived from a 60 cycle source. Pairs of light bulbs 6, each in series with a diode, are connected in series with individual silicon controlled rectifiers poled in the same direction as the diode to separate lines 14 and 15.

Enable ports of an electronic control system, adapted to detect the phase of the operating current lines, is connected through resistors 19 to individual gates of the silicon controlled rectifiers 18. Thus the control system 20 applies signals to the gates of silicon controlled rectifiers 18 during the appropriate phases of the power applied to lines 14 and 15, causing power to pass through the appropriate light bulb of each pair during the corresponding current phase, should a particular light bulb be required to be illuminated.

It is clear, therefore, that the number of silicon controlled rectifiers which operate as electronic switches for each of the light bulbs is reduced by one-half over the number of normal and/or transistor switches which would otherwise be required on a one-to-one correspondence. Also there is no requirement for a heavy duty regulated supply to the candle bulbs. The only component required is an inexpensive high current bridge.

It is desired in the present invention to apply operating power to all of the light bulbs during an interval which is a small (the last) portion of each current cycle of the related phase of operating power. The interval is selected so that it is virtually invisible to the unaided human eye. The current which passes through the light bulb generates heat, raising the resistance of the light bulbs, and limits the in-rush current which would shorten the life of the light bulbs when they are to be turned visibly on. This substantially increases the life of the light bulbs.

According to a further feature of the present invention, a plurality of system control switches 21 each has one terminal connected to a corresponding gate enable port of control system 20 leading to the gates of the separate silicon controlled rectifiers 18. The other terminal of each of the control switches 21 is connected in common with the others to a sense input of control system 20. During a short interval around the zero point of the operating current for the light bulbs, when the anode-cathode voltage is insufficient to sustain operation, the state of one of the control switches is sensed. Over a series of cycles, the states of all of the system control switches are sensed in succession.

In the preferred embodiment, the ports are successively pulsed at successive zero crossing points of the operating current cycles, and the closed or open state of the pulsed control switch 21 is sensed by the control system at its sense input. Since there is no anode-cathode operating power at the time of the pulse, the presence of pulses at the gates of the silicon controlled rectifiers do not cause them to fire indiscriminately (the current supply in the anode-cathode circuits of the silicon controlled rectifiers being zero).

Clearly the above structure eliminates the requirement for separate control switch ports of the control system 20.

A photo-transistor 22, which corresponds to the photosensor 4 at the end of tube 3 is also connected to control system 20. According to the preferred form of the invention, upon detection of a coil or bill in the coin chute, the light bulbs 6 are operated in sequence over very short time intervals to emit light which is detectable by photo-transistor 22. Since the illumination of the light bulbs 6 is caused by the enabling of a gate of a corresponding silicon controlled rectifier 18 by control system 20 over predetermined time intervals, the timing of the light associated with each bulb is known, and thus the sensing of the light presence during a particular interval by the photoresistor designates which light bulb is to be visibly lit.

In this embodiment two successive half cycles of half wave rectified power should be applied to each light bulb 6 in sequence, which has been found to be sufficient for detection, yet not immediately discernible to the unaided eye. The photo-transistor 22 can be scanned in a similar manner as the system control switches.

A light emitting diode 23 which is light coupled to a photo-transistor 24 across a coin chute can be used to detect the presence of a coin, photo-transistor 24 being scanned similar to control switches 21. Once a coin has been detected, the control system can be enabled to operate the scanning sequence previously described and to monitor light sensor phototransistor 22.

Turning now to FIG. 5, the preferred form of power supply is shown for providing operating power, etc., to the system. A transformer 25 has its primary winding connected to a standard 60 cycle 117 volt AC supply, the secondary of transformer 25 providing operating current at a lower voltage, such as 14 volts. A bridge rectifier 26 is connected across the secondary winding of the transformer, the output of the bridge rectifier providing full wave (120 Hertz) current on lead 27. A bleeder resistor 28 is connected across the output of the rectifier from lead 27 to ground.

A large capacity filter capacitor 29 is connected through a diode 30 to lead 27, and to a standard 5 volt regulator 31 to provide a 5 volt DC supply lead for the control system 20.

Half wave oppositely phased operating current is provided between each of the leads of the secondary winding of transformer 25 and ground, the leads being designated by reference numerals 14 and 15. The timing of the half wave rectified current signals on leads 14 and 15 are shown in FIGS. 5A and 5B. Each of the current waveforms is used to operate the separate light bulbs 6 of each pair of bulbs shown in FIG. 4.

Turning now to FIG. 6, the control system 20 of FIG. 4 is preferably formed of a single chip micro-computer 32 such as the type 8748, connected in a conventional manner to a RAM/IO chip 33 type 8155. Twelve output ports 34 are available from the single chip computer 32 and twenty ports 35 are available at the output of the RAM/IO chip 33. Each of the ports 34 and 35 is connected to a gate of a silicon controlled rectifier 18 (through a resistor 19), thus operating as many as thirty-two silicon controlled rectifiers and sixty-four candle simulating light bulbs.

The full wave rectifier signal on lead 27 (FIG. 5) is applied through a resistor 36 to the non-inverting input of operational amplifier 37 (the inverting input being connected through resistor 38 to +5 V), the output of operational amplifier 37 being connected to the INTR input of micro-computer 32. This supplies the zero crossing point information to the micro-computer.

Seven of the output ports 35 are individually connected via resistors 39 in series with control switches 40 to the non-inverting input of operational amplifier 41. The output of operational amplifier 41 is connected to one of the input ports T1 of micro-computer 32. The other input of operational amplifier 41 is connected to the +5 V power supply terminal via resistor 49 to provide a constant current bias.

The micro-computer is programmed so that at the zero crossing point of the 60 Hertz operating power, each of which point is indicated by the full wave rectified (120 Hertz) signal appearing at the input of operational amplifier 37 being applied to the micro-computer 32, successive output ports of the RAM/IO chip 33 which lead to switches 40 are pulsed. Should any of the switches 40 be closed, a pulse at input T1 of micro-computer 32 occurs at the time of pulsing of the associated port. Thus the presence of a closed control switch is indicated.

A light-emitting diode 42 is connected in series with resistor 43 between +5 V and ground (or zero V), which causes it to be illuminated. The light-emitting diode is placed on one side of a coin chute and a photo-transistor 44 on the other. Consequently when a coin is placed in the coin chute it interrupts the light beam for a short period.

The photo-transistor 44 is connected between +5 V and the inverting input of an operational amplifier 45, which has its non-inverting input connected to one of the output ports of RAM/IO chip 33 through resistor 46. The port connected to the non-inverting input is pulsed positively to a level of +5 V or higher each scanning cycle, in sequence with the control switches 40. If the light from light-emitting diode 42 falls on photo-transistor 44, the photo-transistor is conductive and the output of operational amplifier 45, is held at a low voltage level, thus inhibiting the pulse from RAM/IO chip 33. However should the light from light-emitting diode 42 be blocked by a coin, the scanning pulse passes through operational amplifier 45 through a resistor 47 which is connected to its output and appears at the non-inverting input of operational amplifier 41, the output of which is sensed by microcomputer 32 and the computer thus determines that the lighting of a light bulb is to follow. It thus commences the sequential scanning of the light bulb (described earlier) and monitors input port TO to which the light bulb sensing photo-transistor is connected as will be described below.

A photo-transistor 22 is connected in series with a sensor gain control potentiometer 48 between +5 V and ground. The junction of photo-transistor 22 and potentiometer 48 is connected through a resistor 49 to the non-inverting input of operational amplifier 50. A threshold setting potentiometer 51 is also connected betwen +5 V and ground, its tap being connected via resistor 52 to the inverting input of operational amplifier 50. The output of operational amplifier 50 is connected to the T0 input of micro-computer 32.

Thus when the photo-transistor light sensor 22 is brought into adjacency to one of the light bulbs during the sequential scanning procedure described earlier, it detects the very short light bursts described earlier and causes a pulse during the illumination interval to pass through operational amplifier 50, which pulse is applied to the T0 input port of micro-computer 32. This port is checked at predetermined timing points similar to the checking of switches 40 for the presence of the pulse, and should the pulse be detected, assuming that the scanning procedure has been initiated due to the detection of the presence of the coin, the computer enters a software routine to illuminate the appropriate light bulb as will be described below.

FIG. 6A shows timing diagrams related to the short illumination burst of the light bulb. In the top figure, the current which is to be applied to each light bulb in succession is shown. As indicated earlier, it is preferred that two successive half-wave rectified pulses should be conducted through each bulb, by enabling the associated silicon controlled rectifier at the proper times. Consequently two half wave current pulses are applied to the first light bulb followed by two pulses to the next, etc. and after all the light bulbs have been pulsed, the cycle begins again.

As shown in the middle diagram in FIG. 6A, a particular light bulb illuminates shortly following the beginning of the first half cycle, then remains illuminated due to its inherent time lag through the remainder of the first pulse, the gap between the two pulses, and it remains illuminated for some time after the completion of the second pulse. Thus a suitably long illumination period is created for each light bulb.

The bottom waveform in FIG. 6A indicate the time interval during which the state of the photo-transistor 22 is checked. Clearly the second checking interval from the left detects the presence of illumination. However if the phototransistor is not near a light bulb it of course will not detect any of the light flashes, and no light bulb, except those already previously selected, will be turned on.

When the first light pulse has been detected a second pulse is initiated several cycles later. The detection of this second pulse initiates the "lighting" of the chosen candle. The second pulse serves as an error check to prevent accidental lighting of a "darkened" bulb in the case of rapidly passing the wand over a light source (such as an already illuminated candle) at the same moment that the "darkened" bulb generates a light pulse.

Turning now to FIG. 7, a half cycle current waveform and timing diagram is shown which will be used to illustrate more fully the concepts of the invention. The top waveform is one-half of a 60 Hertz signal, of the type which appears on either of the lines 14 and 15. Below the waveform is shown a timing diagram. Adjacent the zero points of the half cycle of current a pair of interrupt intervals are shown. During those periods, the silicon controlled rectifiers are non-conductive.

Turn-on time points labelled 1–6 during the interval of the half cycle are also shown, in approximate time scale. These time points are used to trigger the silicon controlled rectifiers conductive as will be described below.

All of the silicon controlled rectifiers are triggered at timing point 6 at the latest. Consequently current having the form of the remainder of the half cycle of operating power from timing point 6 to the interrupt period is passed through the light bulbs. This keeps the filaments of the light bulbs warm and limits in-rush current when lights are visibly turned on.

It should be noted that all "darkened" light bulbs connected to line 14 conduct current at timing point 6 for the remaining duration of one phase of 60 cycle current as described above, and all light bulbs connected to line 15 conduct current from a similar timing point 6 in the immediately following phase. Pairs of light bulbs connected to one silicon controlled rectifier are connected one bulb to each line 14 and 15 as described earlier. Each silicon controlled rectifier is enabled during the appropriate periods of all phases.

In order to provide a pulse of light for detection by the photo-transistor sensor 22 (when a coin or bill is detected in the coin chute), each "darkened" light bulb in succession is caused to conduct additional current, for a period of two successive half cycles of the phase of current which it is connected to conduct, from timing point 1 to the following interrupt period. Consequently nearly the entire rectified current pulses for two half wave cycles are used.

Once a light bulb is indicated to be turned on visibly, rather than switching it on at timing point 6, it should be switched on at timing point 5 at the latest. However, it should alternatively be turned on at one of the earlier turn-on time points, the time points 1–4 being selected randomly. The switch point decision is preferably made by the output of a random number generator program in micro-computer 32. In one embodiment, the random number comprised of four bits is used to control the four switch points for each light bulb individually. The result is a randomly changing light bulb brightness which changes at the rate of rotation of the random number generator. The effect is very similar to that of a candle flickering in a strong breeze.

In order to reduce the amount of flickering, fewer than the four switch points can be used in the random selection procedure. To selectively reduce the amount of flickering, all of the selected bulbs to be illuminated are switched on at switch point 4, with random selection of switch points 2 and 3. A further reduction can be obtained by turning on the bulbs at switch point 3 and randomly selecting switch point 2. Consequently the change between no flickering and full flickering can be simulated by incrementing, or decrementing, the number of switch points used in the flicker effect. The number of switch points can be determined by a binary mask which sets to a logical "1" those switch points not to be randomly selected. If the mask is rotated left and right one rotation at a time, then the flickering will decrease and increase depending on the rotation direction. In the preferred system the mask is rotated every few seconds, but the actual time the mask is rotated is random (selected from the random number generator). The rotation direction is determined from a pre-stored cyclic pattern.

The effect of the random selection of the switch-on timing points described above provide the simulation of a candle flickering. However the random selection of the last allowable turn-on point provides the simulation of the effect of a breeze affecting all of the candles (or groups of candles if controlled in that manner).

A preferred memory map which can be used for the RAM/IO chip 33 and the micro-computer is shown in FIG. 8. The memory is 16 bytes wide. One-half of the memory is used to retain timer information for the period that a particular light bulb should remain visibly on.

Five successive byte locations store the silicon controlled rectifier timing patterns, i.e., the pattern for timing point 2, 3, 4 and 5, at successive memory locations. A test pattern can also be stored, which can be accessed by closure of one of the control switches 40.

It was noted earlier that an operational amplifier 50 provides an output pulse when the light detected by photo-transistor 22 is above a threshold set on potentiometer 51. However it has also been found that the brightness of the light required at the light bulbs for detection by the sensor can be reduced by the use of an 8-bit A/D converter in place of the operational amplifier 50 and its associated circuitry. This allows the micro-computer to determine that the photo-transistor sensor is stationary, that the photo-transistor is adjacent an unlit light bulb, to select the light bulb with a low flickering brightness, and to perform the above at various levels at ambient brightness. A very fast scanning procedure can also be used in this case in order to select a light bulb for illumination.

With a lower flicker brightness level several bulbs can be turned on at once without an adverse visual effect which could occur at higher flicker light levels which would be required for detection of a selected bulb in high ambient light conditions. In that case a successive approximation type procedure preferably is used by the micro-computer to determine the selected bulb. In this procedure an iterative selection procedure is used in which the bulbs are divided first into two groups, then four groups, and so on. The chosen fraction at each step of iteration is the one with the selected bulb in it as determined by the response of the sensor. The selected bulb is then reached after $\log_2 N$, where N is the number of candles, and the result being rounded up to the next integer. This considerably reduces the time taken to search for the selected candle.

As an example, if 64 candles are used, the successive approximation procedure takes only six steps in contrast to 64 steps using the scanning procedure described earlier.

To facilitate a lower flicker level brightness for the selection procedure just described, each bulb need only be turned on for one-half cycle, rather than two half cycles. This provides an extra factor of speed over the embodiment described earlier. An apparently instantaneous selection is thus facilitated.

A flow chart of the program for the micro-computer is shown in appendix A, parts A, B and C. Each of the steps of the flow chart is labelled as to function and is believed to be self-explanatory to a person understanding this invention and understanding programming of micro-computers. The operation of the control system described above can of course alternatively be provided using dedicated logic in place of the micro-computer. The algorithm for its operation is contained in the description above.

It should be noted that this invention contemplates that rather than the wand containing a photosensor, each of the light bulbs can utilize photosensors placed in adjacency and the wand can contain an illuminated light bulb at its tip. The control circuity is connected to the photosensors, and sense the light bulb from the wand during particular sensor scanning intervals, when the wand tip is brought near a photosensor. A determination of the time of scanning of the sensor which picks up the light facilitates deduction of which light bulb has been selected for illumination. In this case, of course, the light bulbs are not pulsed on for the selection process as described earlier; this embodiment provides the inverse structure with the light bulb in the wand. Care must be taken to ensure that ambient light does not give a false selection indication.

Of course, the candle simulating flickering aspect of this invention can also be used with electrostatic "touch" switching of a selected simulated candle, or with the basic manually operated switch system found in currently marketed systems.

It will be understood by a person skilled in the art understanding this invention that variations and other embodiments may be designed, using the principles described herein. All are considered to be within the sphere and scope of this invention as defined in the claims appended hereto.

I claim:

1. A decorative light array comprising:
(a) a plurality of light bulbs,
(b) a wand for manually pointing to a light bulb,
(c) means for sensing which light bulb has been pointed to by the wand, and
(d) means for lighting the light bulb upon said sensing having been completed.

2. A simulated candle array comprising:
(a) a plurality of light bulbs, mounted so as to look like an array of candles,
(b) means for applying short bursts of current to said light bulbs, so as to repetitively illuminate light bulbs for short intervals in a sequence during a candle selection process,
(c) a sensor to be manually brought into adjacency to one of said light bulbs,
(d) means connected to said sensor for detecting at least one of said short intervals of illumination of said one of said light bulbs caused by said short bursts of current, and
(e) means for applying operating current to said one light bulb so as to light it visibly to the unaided eye upon said sensing having been completed.

3. A simulated candle array as defined in claim 2, including means for randomly modulating the operating current so as to give said one and other lit light bulbs the appearance of flickering.

4. A simulated candle array as defined in claim 2, including means for applying operating current to said one and other light bulbs visibly lit to the unaided eye during varying and random time intervals so as to give said one and other light bulbs the appearance of random flickering.

5. A simulated candle array as defined in claim 4 including means for further modulating said time intervals in unison so as to give said one and other light bulbs the appearance of an unified and varying intensity of flickering modulated with the random flickering, thus simulating the brightening and darkening effect of a breeze operating on an array of lit and flickering candles.

6. A simulated candle array as defined in claim 4 including means for applying half wave rectified operating current to said light bulbs, gate controlled switch means connected in series with said light bulbs, control means for applying control signals to the gates of the switch means for enabling the switch means in sequence for said short intervals, said sensor being comprised of a light sensor, said means for applying operating current including means for applying said operating current during predetermined intervals of serial half waves of said rectified current.

7. A simulated candle array as defined in claim 6 in which the gate controlled switch means is comprised of silicon controlled rectifiers, means for providing lines carrying alternate phases of half wave rectified current for illuminating said light bulbs, pairs of said light bulbs being connected to opposite phased ones of said lines, each bulb of a pair of light bulbs being connected in series with a diode and both being connected to a silicon controlled rectifier forming said switch means and poled in the same direction as the diodes and in conductive direction relative to the phase of the operating current, the control means including means for detecting which phase of operating current is being applied to said lines.

8. A simulated candle array as defined in claim 7 further including a plurality of ports for carrying said switch control signals, a plurality of control switches for controlling said control means connected to said ports, and means for sequentially scanning the operation of said control switches during intervals encompassing successive zero crossing points of an alternating voltage associated with said half wave rectified current, the voltage of said latter intervals being insufficient to operate said silicon controlled rectifiers.

9. A simulated candle array as defined in claim 8 in which said sensor includes a semiconductor which conducts current in excess of a predetermined threshold in the presence of a light, and including means for connecting the output of said semiconductor to an input of said control means for scanning the semiconductor current in sequence with said control switches.

10. A simulated candle array as defined in claim 2, 6 or 9 in which said light bulbs are incandescent, and means for applying repetitive short bursts of current to all of said light bulbs not otherwise conducting current for intervals virtually unseen to the unaided eye for generating heat in said light bulbs thereby increasing their resistance whereby any subsequent in-rush current thereto will be limited.

11. A simulated candle array as defined in claim 4, further including means for applying half wave rectified operating current to said light bulbs, said control means including random number generator means, and means for enabling application of said operating current to said light bulbs during periods of said half wave operating current depending on a number generated by said random number generator means.

12. A simulated candle array as defined in claim 11 in which said periods of said half wave current are comprised of a predetermined final portion of a sinusoidal half wave current pulse applied to said light bulbs to which is added an adjoining portion of the same current pulse, the time period of the adjoining portion being randomly varied according to a number generated by the random number generator, each being different for at least the majority of said light bulbs.

13. A simulated candle array as defined in claim 12 including means for varying the period of said predetermined final portion to a time interval which is more than half of the time interval of the half wave current pulse, said predetermined final portion being similar for all or a substantial number of said light bulbs.

14. A simulated candle array as defined in claim 13 including gate controlled switch means connected in series with said light bulbs, control means for applying control signals to the gates of the switch means for enabling the switch means in sequence for short said intervals, said sensor being comprised of a light sensor, said means for applying operating current including means for applying said operating current during predetermined intervals of serial half waves of said rectified current.

15. A simulated candle array as defined in claim 14 in which the gate controlled switch means is comprised of silicon controlled rectifiers, means for providing lines carrying alternate phases of half wave rectified sinusoidal current for illuminating said light bulbs, pairs of said light bulbs being connected to opposite phased ones of said lines, each bulb of each pair of light bulbs being connected in series with a diode and both being connected to a silicon controlled rectifier forming said switch means and poled in the same direction as the diodes and in conductive direction relative to the phase of the operating current, the control means including means for detecting which phase of operating current is being applied to said lines.

16. A simulated candle array as defined in claim 15 further including a plurality of ports for carrying said switch control signals, a plurality of control switches for controlling said control means connected to said ports, and means for sequentially scanning the operation of said control switches during intervals encompassing successive zero crossing points of an alternating voltage associated with said half wave rectified current, the voltage of said latter intervals being insufficient to operate said silicon controlled rectifiers.

17. A simulated candle array as defined in claim 16 in which said sensor includes a semiconductor which conducts current in excess of a predetermined threshold in the presence of a light, and including means for connecting the output of said semiconductor to an input of said control means for scanning the semiconductor current in sequence with said control switches.

18. A simulated candle array as defined in claim 2, 6 or 11 further including means for detecting the presence of a coin at a predetermined physical location, and for enabling the means for generating and detecting said short intervals of illumination upon detection of the presence of said coin.

19. A simulated candle array comprising:

(a) a plurality of light bulbs, (b) means for applying cyclic operating current to said light bulbs, (c) means for modulating the timing of said current whereby said current is carried by said light bulbs during at least a predetermined portion of each cycle of said current, and (d) means for randomly extending the period of application of said current during each cycle differently and separately to a major portion of said light bulbs to provide the appearance of random flickering of said bulbs.

20. A simulated candle array as defined in claim 19, including means for randomly extending and reducing the timing of said predetermined portion of said current to at least said major portion of said light bulbs together, to provide the appearance of the general increase and decrease of light effected by a breeze acting on a plurality of candles together.

* * * * *